US005664273A

United States Patent [19]

Obriot

[11] Patent Number: 5,664,273

[45] Date of Patent: Sep. 9, 1997

[54] MATTRESS ASSEMBLY

[76] Inventor: Kelly M. Obriot, 1735 Golfview Dr., Dearborn, Mich. 48124

[21] Appl. No.: 636,057

[22] Filed: Apr. 22, 1996

[51] Int. Cl.[6] ..... A47D 7/00

[52] U.S. Cl. ..... 5/724; 5/739; 5/98.3

[58] Field of Search ..... 5/724, 725, 739, 5/98.3, 110, 111, 400, 201

[56] References Cited

U.S. PATENT DOCUMENTS

| | | | |
|---|---|---|---|
| 1,270,780 | 7/1918 | Bugg | 5/110 X |
| 1,736,341 | 11/1929 | Eiser . | |
| 2,025,659 | 12/1935 | Gilquin . | |
| 2,400,790 | 5/1946 | Tolen . | |
| 2,493,067 | 1/1950 | Goldsmith . | |
| 2,695,413 | 11/1954 | Ter Maat . | |
| 2,695,415 | 11/1954 | Holton . | |
| 2,815,516 | 12/1957 | Holton . | |
| 2,924,832 | 2/1960 | Knowles | 5/468 X |
| 3,135,974 | 6/1964 | Roman . | |
| 3,197,789 | 8/1965 | Ashkouti et al. | 5/110 |
| 3,486,177 | 12/1969 | Marshack . | |
| 3,529,310 | 9/1970 | Olmo . | |
| 4,620,337 | 11/1986 | Williams et al. . | |
| 4,686,724 | 8/1987 | Bedford . | |
| 4,688,285 | 8/1987 | Roberts . | |
| 4,768,250 | 9/1988 | Kato . | |
| 4,768,251 | 9/1988 | Baskent . | |
| 4,898,164 | 2/1990 | Baumberg . | |
| 5,317,767 | 6/1994 | Harget et al. . | |
| 5,561,876 | 10/1996 | Petruzella | 5/724 |

*Primary Examiner*—Michael F. Trettel
*Attorney, Agent, or Firm*—Harness, Dickey & Pierce P.L.C.

[57] ABSTRACT

A mattress assembly designed to allow passive air to flow through the mattress and away from a baby. The mattress assembly includes a lightweight frame member with openings on all four sides and a breathable slip-on mattress cover which fits snugly over the frame. An infant is positioned upon the mattress over the bed frame opening, thereby allowing the air to pass through the breathable mattress cover.

16 Claims, 2 Drawing Sheets

Fig - 1
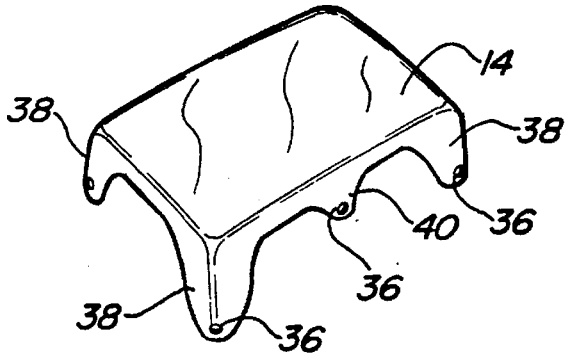
Fig - 2
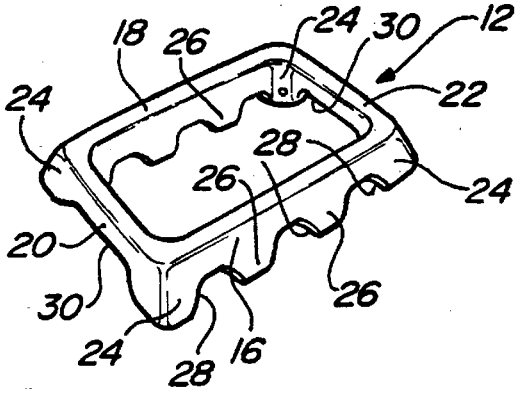
Fig - 3
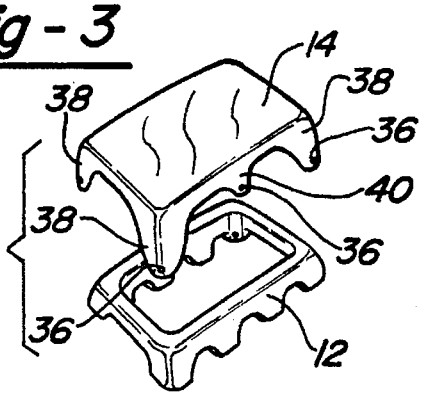
Fig - 4
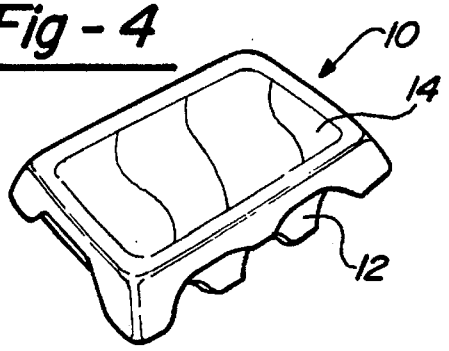
Fig - 5
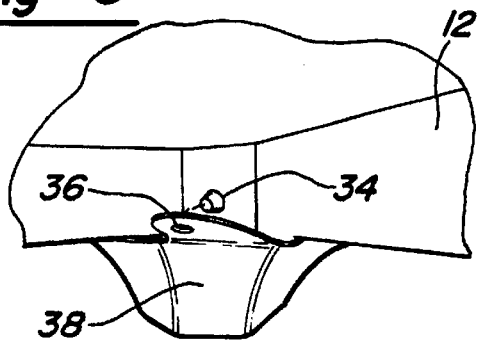
Fig - 6
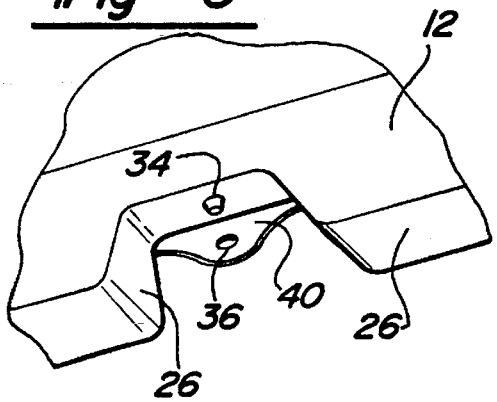
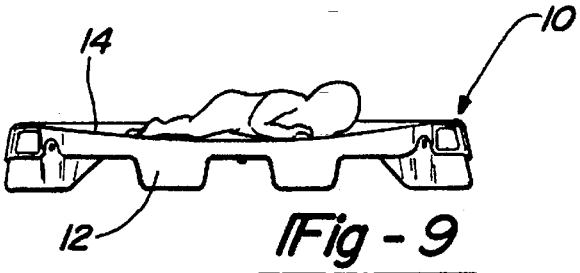
Fig - 9

Fig - 7
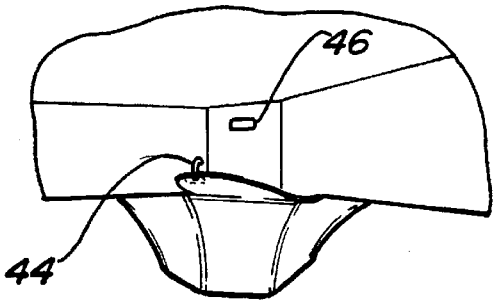
Fig - 8
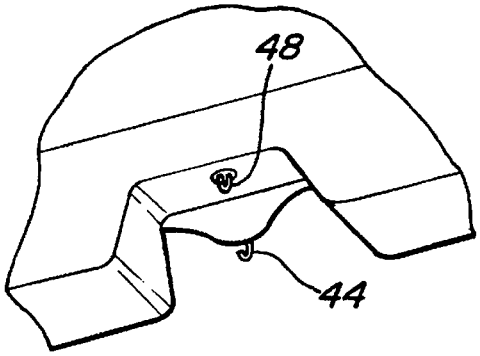
Fig - 10
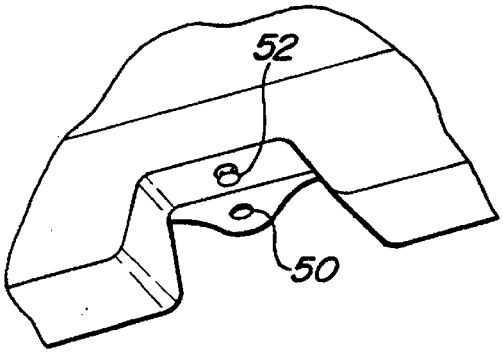
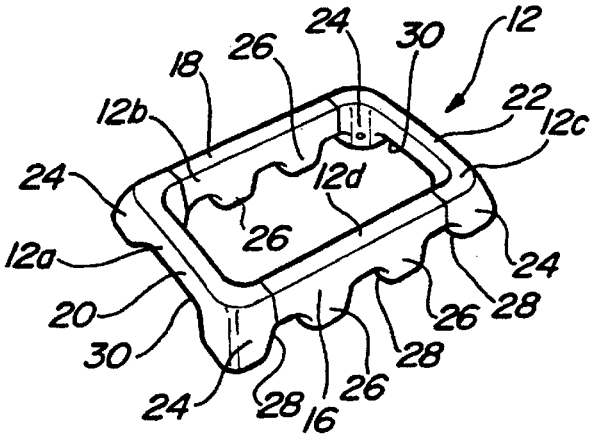
Fig - 11

MATTRESS ASSEMBLY

BACKGROUND OF THE INVENTION

1. Field of the Invention

The present invention relates to infant mattress structures, more particularly, to suspension-type mattress including a breathable material which is supported in tension over a frame structure for allowing the free flow of air therethrough in order to reduce the risk of suffocation or asphyxiation for an infant or small child sleeping on the mattress.

2. Description of Background Art

Currently, the medical community has no conclusive evidence as to the cause of sudden infant death syndrome (SIDS). However, the prevailing theories as to the cause of SIDS are (1) suffocation due to the infant lying in such a manner as to cut off the supply of oxygen and (2) asphyxiation caused by the infant breathing in its own carbon dioxide which may become trapped in a pocket created by the covers being in close proximity to the infant's head.

Breathable mattresses have been designed in order to reduce the risk of suffocation or asphyxiation. However, these mattress designs have been too complex in design, requiring multiple frame members or multiple mattress portions. U.S. Pat. No. 2,695,415 relates to a mattress construction for infants having a cushion-like body supporting section and a relatively thin porous head supporting section co-extensive therewith, with a bent tubular frame structure for supporting the porous head supporting section substantially in the plane of the upper surface of the body supporting section and providing an air space below the porous head supporting section. The thin porous head supporting section is designed to allow air to circulate through the mattress in order to avoid the danger of the infant smothering when he or she rolls over and lies on his or her stomach. The thin porous support is designed to slip over a portion of a skeleton framework formed from light tube or rod bent to form upper and lower substantially U-shaped elements. A problem with the mattress disclosed in U.S. Pat. No. 2,695,415 is that the mattress is comprised of separate mattress sections including a specially designed body support section and the specially designed head supporting section. Therefore, the mattress is expensive to manufacture. Furthermore, because there are two separate mattress sections, cleaning of the mattress is still as complicated if not more complicated than cleaning conventional mattresses.

A safety mattress design is also disclosed in U.S. Pat. No. 2,815,516 issued to Holton on Dec. 10, 1957. The safety mattress includes a receiving member for the user's body and head which is formed of relatively thin flexible porous webbed material, a generally rectangular frame member formed of rigid material across the internal opening of which the webbed material extends in a tensioned condition, and a mattress base member having a generally rectangular configuration which is provided with spaced apart upstanding spacer elements which are located at opposite sides thereof and which serve to support the assembled frame member and stretched webbed material a spaced distance above an upper surface of the base member. A problem with the safety mattress of U.S. Pat. No. 2,815,516 is that the mattress design requires both a first frame member for supporting the porous web material and a separate base member for supporting the first frame member so that the web material is suspended a predetermined distance above the base member. Furthermore, the first frame member, the base member, and the flexible porous webbed material all require separate cleaning.

Therefore, it is desirable in the art of infant mattresses to provide a mattress assembly which is simple in structure, self supporting, easy to clean, and easy to assemble and disassemble.

SUMMARY OF THE INVENTION

Accordingly, it is an object of the present invention to provide a mattress which eliminates or reduces the possibility of infants and young children suffocating in the event they are sleeping face downward.

It is yet another object of the present invention to provide a mattress assembly which prevents the accumulation of undesired liquids such as body expelled fluids, milk, or other fluid leakage from a baby's bottle or the like, which may cause the infant or child to choke.

It is yet another object of the present invention to provide a mattress assembly which will also help prevent an infant or child from asphyxiating due to a build up of carbon dioxide that may become trapped in a pocket in the child's blankets in close proximity to the infant or child's head.

It is still another object of the present invention to provide a mattress assembly that permits the infant's or child's pores to breath and enhances air circulation around the child's body to eliminate unevenness of body temperature and the build up of moisture from perspiration and condensation which occur when conventional mattresses are used.

It is still another object of the present invention to provide a mattress assembly having a suspended breathable mattress which may be easily removed for laundering and a frame for suspending the mattress which can be easily cleaned and disinfected.

It is yet another object of the present invention to provide a mattress assembly which is simple in structure, easy to manufacture, and inexpensive to mass produce.

These and other objects of the present invention are obtained by providing a mattress assembly, comprising a generally rectangular lightweight frame member including four sidewalls defining an opening therebetween. The frame member which is preferably made from a plastic material or a rigid high density foam includes a top surface and a bottom surface, the bottom surface having at least one recessed portion for allowing air passage between said recessed portion and a flat surface on which said frame member is placed; and a cover member, made from a breathable porous fabric material, suspended across said opening of said frame structure and releasably secured to said frame structure. The frame structure can be manufactured as a single (1) part or can be comprised of separate pieces which are assembled. A four part construction provides a more economical means for shipping the mattress assembly.

The mattress assembly of the present invention has been designed to allow passive air to flow through the mattress and away from the baby. In this regard, the mattress assembly frame is provided with openings on all four sides and a breathable slip-on cover which fits snugly over the bed frame. Due to the elastic properties of the cover, the infant is suspended over the bed frame, thereby allowing the air to pass through the breathable cover, and in the process reducing the possibility of suffocation and asphyxiation.

Further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not intended to be limiting of the present invention, wherein:

FIG. 1 is a perspective view of a mattress assembly according to the principles of the present invention;

FIG. 2 is a perspective view of a frame structure for a mattress assembly according to the principles of the present invention;

FIG. 3 is a perspective view of a mattress cover for a mattress assembly according to the principles of the present invention;

FIG. 4 is a perspective view of the mattress cover as shown in FIG. 3 being assembled over the frame structure as shown in FIG. 2, according to the principles of the present invention;

FIG. 5 illustrates a manner of securing the mattress cover to the frame structure according to a preferred embodiment of the present invention;

FIG. 6 is an illustration of a preferred method of securing a side flap of the mattress cover to the frame structure according to the principles of the present invention;

FIG. 7 illustrates a second method of securing the cover member to the frame structure using a hook and loop method according to the principles of the present invention;

FIG. 8 illustrates a second method of securing the side flap of the cover member to the frame member using a hook and loop method according to the principles of the present invention;

FIG. 9 is a cross-sectional view of the mattress assembly according to the principles of the present invention with an infant being illustrated on the mattress assembly lying on its stomach;

FIG. 10 illustrates a third method of securing the side flap of the cover member to the frame member using a rotating thumb lock; and FIG. 11 illustrates a frame member which is made of a plurality of frame segments.

DETAILED DESCRIPTION OF THE PREFERRED EMBODIMENTS

The present invention relates to a mattress assembly 10 for use by infants in reducing the possibility of suffocation or asphyxiation. The mattress assembly 10 includes a frame member 12 having a generally rectangular configuration and a mattress cover 14 supported in tension over the frame member 12.

The frame member 12 is provided with sidewalls 16, 18, which extend the length of the frame member 12 and which are joined to one another by sidewalls 20, 22 which extend the width of the frame member 12. At the intersection of each of the sidewalls 16–22, a support leg 24 is provided for supporting the frame member 12 on a flat surface. The sidewalls 16, 18 which extend the length of the frame member 12 are preferably provided with additional intermediate support portions 26 for providing additional support for the frame member 12. The intermediate support portions 26 define recessed portions 28 on each side thereof which allow the free flow of air into the space defined beneath the mattress cover 14 when the mattress cover 14 is in its assembled position as shown in FIG. 1. The sidewalls 20, 22 which extend the width of the frame member 12 are also provided with recessed portions 30 which allow the passage of air between the recessed portions 30 and a flat surface on which the plastic frame member 12 is placed. The frame member 12 can be manufactured as a single (1) post or can be comprised of separate pieces which are assembled together as shown in FIG. 11 including frame segments 12*a*–12*d*. Segments 12*a* and 12*c* make up the sidewalls 20, 22 which extend the width of the frame member 12 while segments 12*b* and 12*d* make up the sidewalls 18, 16 which extend the length of the frame member 12.

As shown in FIGS. 5 and 6, the frame member 12 is provided with a first snap portion 34 at a location on an inner surface of each of the leg portions 24 as shown in FIG. 5 and in a location between the intermediate support legs 26 as shown in FIG. 6. The mattress cover 14 is provided with corresponding snap members 36 which engage the snap members 34 for securing the mattress cover 14 on the frame member 12. The snap members 36 are provided on corner and side wrap portions 38, 40 respectively, which are provided at each of the comers and at two intermediate side locations, respectively.

As an alternative to the snap members 34, 36, a hook 44 attached to the mattress cover 14 may be used for engaging a hole 46 provided in the surface of the frame member 12 as shown in FIG. 7 or for engaging with a loop 48 attached to the frame member 12 as shown in FIG. 8.

The mattress cover 14 should be made from a breathable/porous material such as cotton gauze. In areas where the fasteners are located, i.e. metal snaps 36, the mattress cover 14 may be reinforced to prevent against ripping after prolonged use. Furthermore, an elastic band may be added around the whole or part of the mattress cover 14 to ensure a snug fit around the bed frame. The mattress cover 14 is intended to be removed when soiled and able to withstand numerous washings. Another alternative is that a hook and loop type fastener such as VELCRO™ may be used to fasten the mattress cover 14 to the frame member 12.

The frame member 12 can be manufactured by using injection molding, blow molding, or other similar known processes. The frame member 12 can also be made from a thermoset or thermoplastic material. As shown in the cross-sectional view of FIG. 9, the frame member 12 is preferably hollow in cross section and formed as a unitary member, i.e. one piece. However, it should also be recognized that the frame member 12 may also be made of a semi-rigid foam material and may include an encapsulated reinforcing structure extending into the legs of the frame member.

There are several methods for fastening the mattress cover 14 to the frame member 12. The drawings illustrate the use of metal snaps and a hook and loop system for fastening the mattress cover 14 to the frame member 12. The snaps 34 can either be insert molded or rivetted onto the frame member 12, and the top half of the snap 36 is attached to mattress cover 14 by known methods. In the hook and loop system, hook 44 can be sewn onto the mattress cover 12 while the loop can be a hole 46 which is provided in the plastic frame member 12 or a separate hook 48 which could be fastened to frame member 12 as a separate piece or molded into frame member 12 directly. Another means of fastening the mattress cover 14 to the frame member 12 is a rotating thumb lock, whereby a metal slotted grommets 50 are attached to the mattress cover 14 which fit over rotating thumb latches 52, as shown in FIG. 10. The latches are then rotated 90° to securely lock the mattress cover 14 into position.

The breathable mattress assembly 10 has been designed to allow passive air to flow through mattress cover 14 and away from the baby. The mattress assembly 10 is composed of a lightweight frame member 12 which allows the free flow of air on all four sides and a breathable slip-on-cover mattress cover 14 which fits snugly over the frame member 12. Due to the elastic properties of the mattress cover 14, the infant is suspended over the bed frame, thereby allowing the air to pass through the breathable cover 14, and in the process reducing the possibility of suffocation and asphyxiation.

The advantages of the mattress assembly 10 according to the present invention is that it greatly reduces the possibility of infants and young children suffocating when sleeping face downward to the breathable mattress material which is supported in tension with an air space located underneath it. In addition, the present invention prevents the accumulation of undesired liquids such as body expelled fluids, milk, or other food leakage from a baby's bottle and the like, which may cause the infant or child to choke. This product may also help protect an infant or child from asphyxiation due to a build up of carbon dioxide that may become trapped in a pocket in the child's blankets in close proximity to the infant or child's head. Also, the breathable mattress material permits the infant's or child's pores to breath and enhances air circulation around the child's body to eliminate unevenness of body temperature and the build up of moisture from perspiration and condensation which occur when conventional mattresses are used. Particularly, those formed with a plastic or waterproof covering.

In addition to the above described advantages, the suspended breathable mattress may be easily removed for laundering and the frame which suspends the mattress can be easily cleaned and disinfected requiring only a fraction of the effort required to maintain a conventional mattress. It may be necessary to include a tray underneath the frame member 12 in order to catch any expelled liquids. The tray could be made from a variety of materials as well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A mattress assembly, comprising:

frame member disposable on a desired surface including sidewalls defining an opening therebetween, said frame member having a top surface and a bottom surface, said bottom surface having at least one recessed portion for allowing air passage between said recessed portion; and a mattress cover, made from a breathable/porous fabric material, suspended across said opening of said frame member and releasably secured to said frame member.

2. The mattress assembly according to claim 1, further comprising leg portions provided in each corner of said frame member wherein said mattress cover includes a plurality of corner wrap portions which are designed to wrap around each of said corner leg portions of said frame member.

3. The mattress assembly according to claim 2, further comprising a plurality of intermediate leg portions disposed along said sidewalls of said frame member wherein said mattress cover includes side wrap portions disposed on opposite sides thereof for wrapping under said frame member between each of said intermediate leg portions.

4. The mattress assembly according to claim 1, wherein said frame member is a self supporting unitary member made from a lightweight material.

5. A mattress assembly, comprising:

a generally rectangular plastic frame member disposable upon a desired surface including four sidewalls defining an opening therebetween, said plastic frame member having a top surface and a bottom surface, said bottom surface having at least one recessed portion for allowing air passage between said recessed portion;

a cover member, made from a breathable/porous fabric material, supported in tension across said opening of said frame structure; and means for releasably securing said cover member to said frame structure.

6. The mattress assembly according to claim 5, wherein leg portions are provided in each corner of said frame member and said mattress cover includes a plurality of corner wrap portions which are designed to wrap around each of said corner leg portions of said frame member and are secured to an inner surface of said leg members.

7. The mattress assembly according to claim 6, further comprising a pair of intermediate leg portions on two of said sidewalls of said frame member wherein said mattress cover includes a pair of side wrap portions disposed on opposite sides thereof for wrapping under said frame member between each of said pairs of intermediate leg portions.

8. The mattress assembly according to claim 5, wherein said frame member is a self supporting unitary member.

9. The mattress assembly according to claim 5, wherein said frame member includes a plurality of members assembled together.

10. A mattress assembly, comprising:

a generally rectangular frame member including four sidewalls defining an opening therebetween, said frame member having a top surface and a bottom surface;

a plurality of first fastener members mounted on said frame member; and a cover member, made from a breathable/porous fabric material, supported in tension across said opening of said frame structure and provided with a plurality of second fastener members which are releasably connected to said plurality of first fastener members;

wherein leg portions are provided in each corner of said frame member and said mattress cover includes a plurality of wrap portions which are designed to wrap under each of said corner leg portions of said frame member.

11. The mattress assembly according to claim 10, wherein said plurality of first and second fastener members include a plurality of first and second metal snap members.

12. The mattress assembly according to claim 10, wherein said plurality of first and second fastener members include a plurality of hook and loop members.

13. The mattress assembly according to claim 10, further comprising a pair of intermediate leg portions on two of said sidewalls of said frame member wherein said mattress cover includes a pair of side wrap portions disposed on opposite sides thereof for wrapping under said frame member between each of said pairs of intermediate leg portions.

14. The mattress assembly according to claim 10, wherein said frame member is a self supporting unitary lightweight member.

15. The mattress assembly according to claim 10, wherein said frame member includes a plurality of members assembled together.

16. The mattress assembly according to claim 10, wherein said plurality of first and second fastener members include a plurality of thumb latches and a plurality of grommets.

* * * * *